United States Patent [19]

Wolf

[11] Patent Number: 4,666,418

[45] Date of Patent: May 19, 1987

[54] NON-TIPPABLE TOY

[76] Inventor: Tobin Wolf, 1610 Harmon Cove Towers, Secaucus, N.J. 07094

[21] Appl. No.: 783,049

[22] Filed: Sep. 30, 1985

Related U.S. Application Data

[63] Continuation of Ser. No. 623,457, Jun. 22, 1984, abandoned.

[51] Int. Cl.[4] ..... A63H 15/04

[52] U.S. Cl. ..... 446/273; 446/289; 446/471

[58] Field of Search ..... 446/273, 274, 289, 290, 446/471, 431, 465, 99, 95, 94, 93, 269, 458

[56] References Cited

U.S. PATENT DOCUMENTS

| | | | |
|---|---|---|---|
| 1,223,287 | 4/1917 | Morse | 446/273 |
| 1,270,456 | 6/1918 | Stacy | 446/273 |
| 1,699,138 | 1/1929 | Fuld | 446/290 |
| 1,763,903 | 6/1930 | Perkins | 446/273 |
| 2,519,248 | 8/1950 | Hulbert | 446/273 |
| 2,802,300 | 8/1957 | Rogers | 446/273 |
| 3,807,085 | 4/1974 | Campbell, Jr. | 446/273 |
| 3,826,039 | 7/1974 | Disko et al. | 446/465 X |

FOREIGN PATENT DOCUMENTS

| | | | |
|---|---|---|---|
| 1442582 | 7/1976 | United Kingdom | 446/458 |

*Primary Examiner*—Mickey Yu
*Attorney, Agent, or Firm*—Jay M. Cantor

[57] ABSTRACT

The disclosure relates to a non-tippable toy which is capable of rocking about an axis and ultimately resting in a vertical position and which is also capable of motion in a lateral direction by utilizing an axle having a pair of wheel-like members affixed thereto, the axle being rotably mounted in the body of the toy so that the toy is capable of rocking about the axis. The toy also includes weights secured to the bottom of the toy body by means of a spring fastener or the like to provide the low center of gravity. The toy body includes a pair of shoulders thereon, preferably surrounding the shaft, which receive components thereon designed to alter the configuration of the toy. Numerous aspects can be provided to the toy by replacing the wheels with a plurality of feet in the shape of a wheel so that the lateral motion of the toy is not impaired. Also, the wheels can be mounted on the shaft in an off-center position to provide a side to side and up and down motion to the toy during lateral motion thereof. Due to the configuration as set forth hereinabove, the toy itself is always capable of rocking on the axle and ultimately returning to its initial upright position due to the low center of gravity of the weights which are positioned beneath the axle and within the toy.

21 Claims, 9 Drawing Figures

NON-TIPPABLE TOY

This application is a continuation of application Ser. No. 623,457, filed June 22, 1984, now abandoned.

BACKGROUND OF THE INVENTION

1. FIELD OF THE INVENTION

This invention relates to a non-tipable toy wherein the toy will always resume an erect position after having been displaced from such erect position.

2. DESCRIPTION OF THE PRIOR ART

Non-tipable toy articles have been well known in the prior art. These toys have normally taken on the configuration of having a weight located in the bottom portion thereof in order to form the non-tipable structure. This weight location provides the required low center of gravity for non-tipable action. A typical such prior art device set forth in U.S. Pat. No. 3,805,444 of Adickes which is representative of the prior art. The prior art non-tipable toys, as exemplified by the above noted patent, are confined to a rocking motion in that they rock about a circular base. However, these prior art non-tipable toys have been devoid of other forms of motion in addition to their non-tipability which can add a significant dimension to the play value of the toy be permitting it to travel in lateral directions as well as displaying the rocking motion.

SUMMARY OF THE INVENTION

In accordance with the present invention, there is provided a non-tipable toy which is capable of rocking about an axis and ultimately resting in a vertical position and which is also capable of motion in a lateral direction. Briefly, the above is provided by utilizing an axle having a pair of wheel-like members affixed thereto, the axle being rotatably mounted in the body of the toy so that the toy is capable of rocking about the axis. The toy also includes weights secured to the bottom of the toy body by means of a spring fastener or the like to provide the low center of gravity. The toy body includes a pair of shoulders thereon, preferrably surrounding the shaft, which receive components thereon designed to alter the configuration of the toy. For example, an automobile chassis can be placed on the shoulders to simulate a person sitting in a vehicle. Numerous aspects can be provided to the toy by replacing the wheels with a plurality of feet in the shape of a wheel so that the lateral motion of the toy is not impaired. Also, the wheels can be mounted on the shaft in an off-center position to provide a side to side and up and down motion to the toy during lateral motion thereof. Due to the configuration as set forth hereinabove, the toy itself is always capable of rocking on the axis and ultimately returning to its initial upright position due to the low center of gravity of the weights which are positioned beneath the axle and within the toy.

DESCRIPTION OF THE PREFERRED EMBODIMENTS

Figure 1:
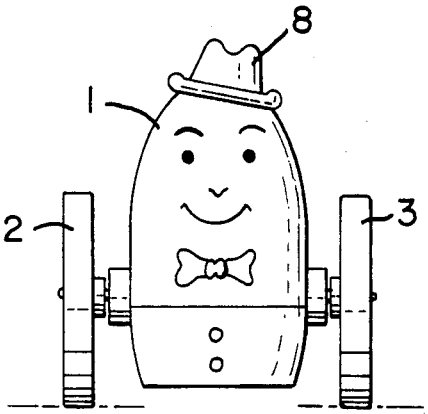
FIG. 1 is a front view of a toy in accordance with the present invention.
Figure 2:
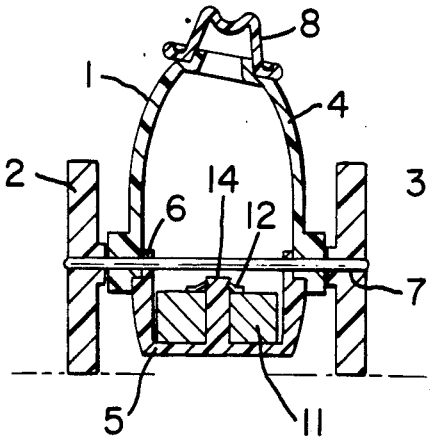
FIG. 2 is a vertical cross section through the center of the body of FIG. 1.

Referring now to FIGS. 1 and 2, there is shown a first embodiment of the present invention. The invention is depicted as a toy in the shape of a fictional character and includes a body 1 mounted on a shaft 7 with wheels 2 and 3 which are non-slidingly affixed to the shaft 7. The body 1 comprises an upper torso portion 4 and a lower torso portion 5., the upper and lower torso portions being aligned by the lip 6 in the lower torso portion which extends along the inside periphery of the lower torso portion. The upper and lower torso portions 4 and 5 are joined together in known manner, such as by cement, sonic fastening or other well known fastening means, the axle 7 being rotatably mounted in the body 1 and being captured by the upper end and lower torso portions. The wheels 2 and 3 are secured to the axle 7, such as by permanent press fitting or the like, so that there is no rotation of the wheels relative to the axle. A weight 11 is disposed in the bottom torso portion 5 at a position below the axle 7, the weight 11 being shaped to conform to the bottom of the lower torso portion and being secured therein by cement or by means of a spring fastener 12 secured to a finger 14 which is integral with the lower torso portion and about which the weight 11 is positioned. A hat or other decorative device 8 may be secured to the torso as shown.

Figure 3:
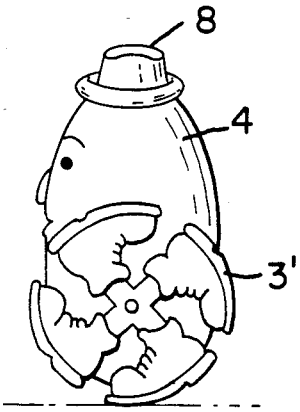
FIG. 3 is a side view of a second embodiment of the present invention.
Figure 4:
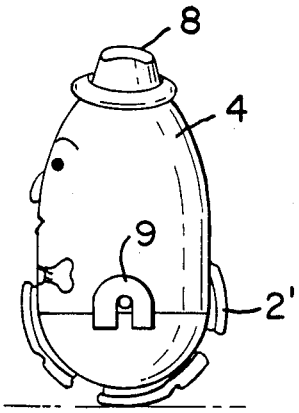
FIG. 4 is a view as in FIG. 3 with a wheel removed.

While the wheels 2 and 3 can be standard disk shaped members, the toy can take on a more realistic and humorous aspect by replacing the wheels 2 and 3 by a plurality of feet 2' and 3' as shown in FIGS. 3 and 4. The feet 3' are shaped so that the soles thereof form a substantial circle as does the wheel, thereby permitting the plurality of feet to replace the wheel and take up the function thereof.

Figure 5:
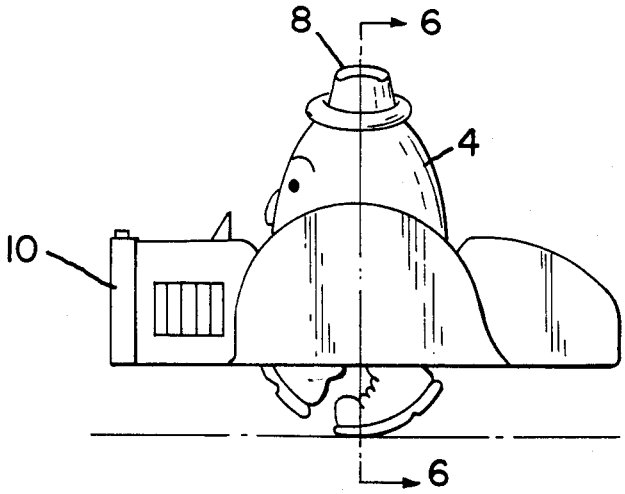
FIG. 5 is a view as in FIG. 3 with a toy addition positioned on the shoulders on the toy as shown in FIG. 4.
Figure 6:
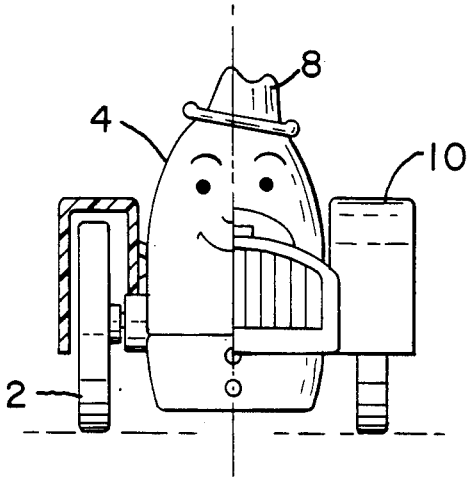
FIG. 6 is a partially cut away front view of the embodiment shown in FIG. 5.
Figure 7:
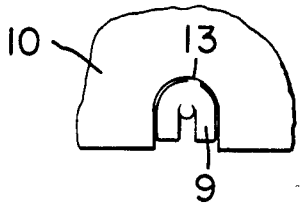
FIG. 7 is an enlarged view of a portion of FIG. 4 with the toy extension of FIG. 5 shown mounted thereon.

Referring now to FIG. 4, the wheel 3' has been removed to reveal a shoulder 9 integrally formed in the upper torso portion 4 to be positioned about the axle 7, though this positioning is not essential. One such shoulder 9 is disposed on each side of the toy body 1. The shoulders 9 provide the function of carrying accessory toy members thereon as shown in FIGS. 5 through 7. As can be seen in these figures, an accessory in the shape of an automobile chassis 10 has been positioned to rest on the shoulders 9. The chassis is positioned over the shoulders 9 by dropping it over the body 1 with the notches 13 thereof resting over the shoulders 9 as best shown in FIG. 7. It is apparent that the body and the chassis are free to roll forwardly and rearwardly as well as to rock on the axle 7 in accordance with this embodiment. It is also readily apparent that a pair of toys of the type described herein can be coupled together to create a four wheeled vehicle as well as other types of vehicles which will be readily apparent to those skilled in the art.

Figure 8:
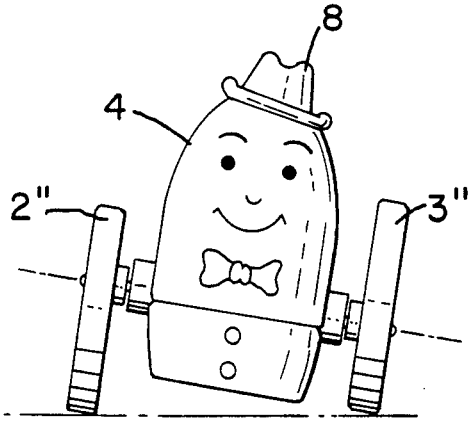
FIG. 8 is a front view of a third embodiment in accordance with the present invention.

Referring now to FIG. 8, there is shown a third embodiment of the invention wherein the wheels 2'' and 3'' replace the wheels of the embodiment of FIG. 1 wherein the wheels 2″ and 3″ are secured to the axle 7 at a position offset from the normal wheel centers to create an eccentric wheel movement. Therefore, upon movement of the toy in a forward or rearward direction, a side to side and up and down motion is provided in addition to the available rocking motion of the body 1 about the axle 7 as the wheels 2″ and 3″ turn and the toy rolls forward.

Referring again to FIGS. 3 and 4, it can be seen that the bottom of the lower torso portion 5 is spherical or cylindrical and in the shape that would be formed by a radius struck from the center of the axle 7. This shape makes it so that the torso portion 5 is free to rock about the axle 7 without touching the floor, thereby avoiding any impediments to the rocking motion.

Figure 9:
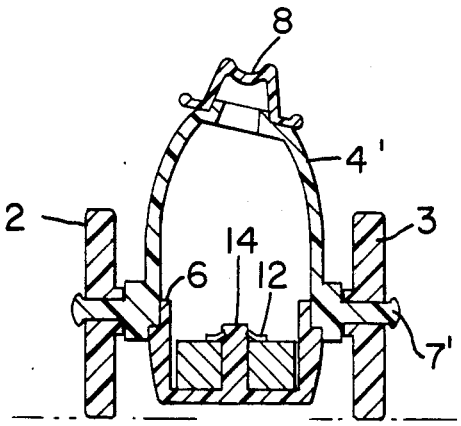
FIG. 9 is a vertical cross section of a fourth embodiment of the invention.

Referring now to FIG. 9, there is shown a fourth embodiment of the invention wherein like character references represent the same structure as in FIG. 2. The difference in this embodiment relative to that of FIG. 2 is that the torso portion 4′ includes the axle 7′ as an integral part thereof rather than supporting a separate axle 7. The wheels 2 and 3 are rotatably mounted on the axles 7′ and retained by swaging the ends of the axles.

It can be seen that there has been provided a non-tippable toy which is capable of other movements as compared with the prior art devices of this type and which greatly enhance the dimension of play value thereof.

Though the invention has been described with specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A non-tippable to which comprises, in combination:

(a) axle means;

(b) substantially circular support means secured to said axle means; and (c) a body portion rotatably mounted on said axle means and disposed entirely above the lowest portion of said support means, the portion of said body disposed below said axle being of greater weight than the portion thereof disposed thereabove;

(d) said toy further including shoulder means integral with said body portion extending outwardly from opposite sides of the body adjacent the axle means, and toy accessory means having openings removably mounted on said shoulder means.

2. A non-tippable toy as set forth in claim 1 wherein said body includes an upper torso portion and a lower torso portion, said lower torso portion including a weight secured therein.

3. A non-tippable toy as set forth in claim 2 wherein said axle means extends through said upper and lower torso portions.

4. A non-tippable toy as set forth in claim 1 wherein said support means is a pair of wheels.

5. A non-tippable toy as set forth in claim 2 wherein said support means is a pair of wheels.

6. A non-tippable toy as set forth in claim 3 wherein said support means is a pair of wheels.

7. A non-tippable toy as set forth in claim 4 wherein at least one of said wheels includes axle receiving means, said axle receiving means being offset from the center of said wheel.

8. A non-tippable toy as set forth in claim 5 wherein at least one of said wheels includes axle receiving means, said axle receiving means being offset from the center of said wheel.

9. A tippable toy as set forth in claim 6 wherein at least one of said wheels includes axle receiving means, said axle receiving means being offset from the center of said wheel.

10. A non-tippable toy according to claim 1 wherein the shoulder means is of a predetermined configuration and said toy accessory means is provided with openings of like configuration for receiving said shoulder means.

11. A non-tippable toy which comprises, in combination:

(a) axle means;

(b) substantially circular support means secured to said axle means; and (c) a body portion rotatably mounted on said axle means and disposed entirely above the lowest portion of said support means, the portion of said body disposed below said axle being of greater weight than the portion thereof disposed thereabove;

(d) said toy further including shoulder means integral with said body portion extending outwardly from opposite sides of the body adjacent the axle means, said axle means extending outwardly from said shoulder means, and (e) toy accessory means having openings removably mounted on said shoulder means.

12. A non-tippable toy as set forth in claim 11 wherein said body includes an upper torso portion and a lower torso portion, said lower torso portion including a weight secured thereto.

13. A non-tippable toy as set forth in claim 12 wherein said axle means extends through said upper and lower torso portions.

14. A non-tippable toy as set forth in claim 11 wherein said support means is a pair of wheels.

15. A non-tippable toy as set forth in claim 12 wherein said support means is a pair of wheels.

16. A non-tippable toy as set forth in claim 13 wherein said support means is a pair of wheels.

17. A non-tippable toy as set forth in claim 14 wherein at least one of said wheels includes axle receiving means, said axle receiving means being offset from the center of said wheel.

18. A non-tippable toy as set forth in claim 15 wherein at least one of said wheels includes axle receiving means, said axle receiving means being offset from the center of said wheel.

19. A non-tippable toy as set forth in claim 16 wherein at least one of said wheels includes axle receiving means, said axle receiving means being offset from the center of said wheel.

20. A non-tippable toy according to claim 11 wherein the shoulder means is of a predetermined configuration and said toy accessory means is provided with openings of like configuration for receiving said shoulder means.

21. A non-tippable toy which comprises, in combination:

(a) axle means;

(b) support means having a substantially circular cross-section secured to said axle means; and (c) a body portion rotatably mounted on said axle means, normally extending simultaneously above and below said axle means and disposed entirely above the lowest portion of said support means, the portion of said body disposed below said axle being of greater weight than the portion thereof disposed thereabove;

(d) said toy further including shoulder means extending outwardly from opposite sides of the body adjacent the axle means, and toy accessory means having openings removably mounted on said shoulder means.

* * * * *